United States Patent [19]

Ikeda

[11] 4,116,269

[45] Sep. 26, 1978

[54] ENGINE RADIATOR WITH MEANS FOR NOISE REDUCTION

[75] Inventor: Hiromichi Ikeda, Tokyo, Japan

[73] Assignee: Kabushiki Kaisha Komatsu Seisakusho, Tokyo, Japan

[21] Appl. No.: 680,699

[22] Filed: Apr. 27, 1976

[30] Foreign Application Priority Data

Apr. 28, 1975 [JP] Japan ..... 50-056834[U]
Sep. 30, 1975 [JP] Japan ..... 50-132855[U]
Sep. 30, 1975 [JP] Japan ..... 50-132856[U]

[51] Int. Cl.[2] ..... E04B 1/99; B60K 11/00; F01P 7/00

[52] U.S. Cl. ..... 165/126; 123/41.49; 123/41.66; 165/135; 180/54 A; 181/224; 181/225; 181/239

[58] Field of Search ..... 165/135, 126; 123/41.49, 41.57, 41.58, 41.65, 41.66; 181/198, 210, 224, 225, 238, 239, 264, 268, 281, 283; 180/54 A, 68 P

[56] References Cited

U.S. PATENT DOCUMENTS

| | | | |
|---|---|---|---|
| 2,115,660 | 4/1938 | Yingling | 165/126 |
| 2,174,677 | 10/1939 | Young | 165/135 |
| 2,270,825 | 1/1942 | Parkinson et al. | 181/224 |
| 3,779,341 | 12/1973 | Huggins | 165/135 |
| 3,820,629 | 6/1974 | Carlson et al. | 165/135 |
| 3,827,482 | 8/1974 | Pope | 165/134 |
| 3,856,100 | 12/1974 | Manning | 180/54 A |
| 3,897,850 | 8/1975 | Thompson et al. | 165/135 |
| 3,923,114 | 12/1975 | Suzuki | 165/135 |
| 3,933,136 | 1/1976 | Burst | 123/41.58 |

*Primary Examiner*—Charles J. Myhre
*Assistant Examiner*—Sheldon Richter
*Attorney, Agent, or Firm*—Armstrong, Nikaido, Marmelstein & Kubovcik

[57] ABSTRACT

For reduction of high intensity sound produced through resonance by a radiator core when the rate of airflow therethrough, supplied by an engine-driven fan, exceeds a critical degree, a plurality of baffle plates are installed on the downstream or upstream side of the radiator core. The baffle plates are spaced from each other in a direction at right angles with the direction of the airflow through the radiator core, in such a manner as to inhibit the resonance of the radiator core when the rate of the airflow exceeds the critical degree.

1 Claim, 8 Drawing Figures

ENGINE RADIATOR WITH MEANS FOR NOISE REDUCTION

BACKGROUND OF THE INVENTION

This invention relates to radiators appended to internal combustion engines for dissipating heat created therein, and pertains more specifically to a radiator with means for reduction of noise caused by an airstream which is supplied by an engine-driven fan. The radiator according to the invention has particular utility in conjunction with engines on earthmoving vehicles or the like, but with no limitations thereto being intended.

A liquid-cooled engine usually has a fan arranged opposite to a radiator core having tubes or other means for conducting the liquid coolant, such as water, piped from jackets surrounding the engine cylinders and cylinder heads. Driven by the engine, the fan forces an airstream through the radiator core for heat exchange with the warmed coolant.

In this type of engine cooling system, as heretofore constructed, the radiator suddenly starts producing high intensity sound as the rate of airflow through the radiator core exceeds a certain value, which is herein termed the critical rate. For reduction of this "radiator noise," the mechanism of its production must be ascertained, and the trouble remedied accordingly, as hereinafter shown and described in greater detail.

SUMMARY OF THE INVENTION

It is therefore an object of this invention to provide a radiator so constructed that the noise production caused by an airstream therethrough is minimized.

Briefly stated, this invention provides, in a radiator having a core arranged opposite to an engine-driven fan for supplying airflow therethrough, the improvement comprising a plurality of baffle plates fixedly mounted in the adjacency of the core. These baffle plates are spaced apart from each other in a direction at right angles with the direction of the airflow through the core so as to minimize resonance of the core when the airflow is supplied in excess of a critical rate by the engine-driven fan.

The above and other objects, features and advantages of this invention will become more clearly apparent from the study of the following detailed description, which is to be read in conjunction with the accompanying drawings wherein like reference characters refer to like parts throughout.

DETAILED DESCRIPTION

Figure 1:
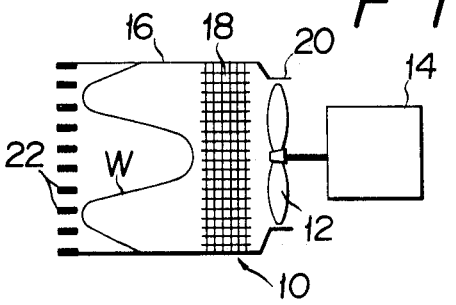
FIG. 1 is a schematic horizontal sectional view explanatory of how the radiator noise is produced by a prior art radiator, the view also schematically showing an engine and a fan driven thereby for supplying airflow through the radiator.

In FIG. 1 of the accompanying drawings a conventional radiator 10 is shown together with a fan 12 driven by an internal combustion engine 14. The radiator 10 comprises an open-ended enclosure 16 in which is accommodated a core 18 of any known or suitable type defining passages for the liquid coolant from the engine 14. The radiator core 18 is opposed on the one hand to the fan 12 surrounded by a shroud 20 at one end of the enclosure 16 and, on the other hand, to a core guard 22 at the other end of the enclosure.

As the engine 14 is started up, the fan 12 is thereby driven to cause a stream of air to flow through the radiator core 18 and out of the enclosure 16 past the core guard 22. The warmed coolant from the engine 14 is thus lessened in temperature as it passes through the radiator core 18 on its way back to the engine.

Figure 2:
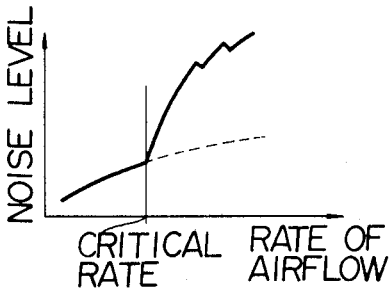
FIG. 2 is a graph plotting the curve of the noise level produced by the prior art radiator of FIG. 1 against the rate of airflow therethrough.

As to the above noted radiator noise, the following explanation, though of somewhat hypothetical nature, seems most reasonable. As graphically represented in FIG. 2, the noise level of the radiator increases to some extent in proportion to the rate of airflow therethrough, which in turn increases in step with engine speed. When the rate of airflow exceeds the aforesaid critical rate, high sound pressure is produced in the adjacency of the radiator core 18 in the form of a wave W extending in the direction at right angles with the direction of the airflow, as shown in FIG. 1. This "sound pressure wave" W induces resonance in the radiator core 18, resulting in the sudden production of high intensity sound as in the graph of FIG. 2.

Therefore, for reduction of the radiator noise, measures should be taken to distort or disturb the sound pressure wave W so that the radiator core may not resonate when the airflow is supplied in excess of the critical rate. Such measures are hereinafter described in terms of several preferred embodiments of the invention.

Figure 3:
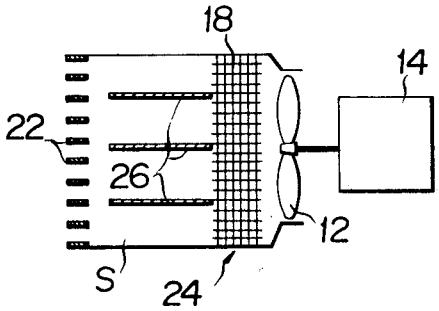
FIG. 3 is a view similar to FIG. 1 but showing a radiator constructed in accordance with the novel concepts of this invention.

FIG. 3 schematically illustrates a radiator 24 constructed in accordance with this invention, together with the fan 12 driven by the internal combustion engine 14. The radiator 24 comprises the core 18 and the core guard 22 with a spacing S therebetween. Fixedly installed in this spacing S within the radiator enclosure 16 are a plurality of baffle plates 26 arranged in parallel spaced relationship to each other and each extending in the direction of the airflow through the radiator core 18. The dimension of each baffle plate 26 in the transverse direction of the radiator, that is, a direction at right angles with that of the airflow therethrough, is such that the baffle plate substantially completely spans the radiator core 18.

For minimizing the radiator noise, the relative positions of the baffle plates 26 in the transverse direction of the radiator should substantially agree with the positions of the crests and roots of the sound pressure wave W which is assumed to be produced as depicted in FIG. 1 when the airflow through the radiator exceeds the critical rate. For, in this manner, the baffle plates 26 will most effectively distort the sound pressure wave, thereby preventing the resonance of the radiator core 18.

Figure 4:
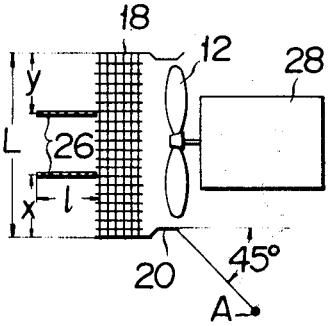
FIG. 4 is also a similar view of experimental equipment employed for finding the optimum locations for baffle plates used in the radiator of FIG. 3.

In order to ascertain the optimum placement for the baffle plates 26 in the transverse direction of the radiator relative to its core, and also to demonstrate the effectiveness of the baffle plates for reduction of the radiator noise, the following experiment was conducted by use of the arrangement shown schematically in FIG. 4.

The experimental arrangement of FIG. 4 includes the radiator core 18 disposed opposite to the fan 12 driven by an electric motor 28, the core and the fan being both life-sized. Two baffle plates 26 were installed vertically on the downstream side of the radiator core 18. The dimension 1 of each baffle plate is 250 millimeters, and the dimensions L of the radiator core 18, which is nearly square in shape, is 1120 millimeters. The noise level produced by the radiator was measured by means of a ⅓ octave noise analyzer positioned at A which is spaced one meter from the fan shroud 20 on its upstream side, in a direction spaced 45° from the notional line parallel to the direction of the airflow through the radiator.

For finding the optimum locations for the baffle plates 26 in the transverse direction of the radiator, distances *x* and *y* were variously changed to observe corresponding changes in noise level at various rates of airflow through the radiator. The airflow was produced by driving the fan 12 with the motor 28, so as to provide incremental variation in the flow rate.

Figure 5:
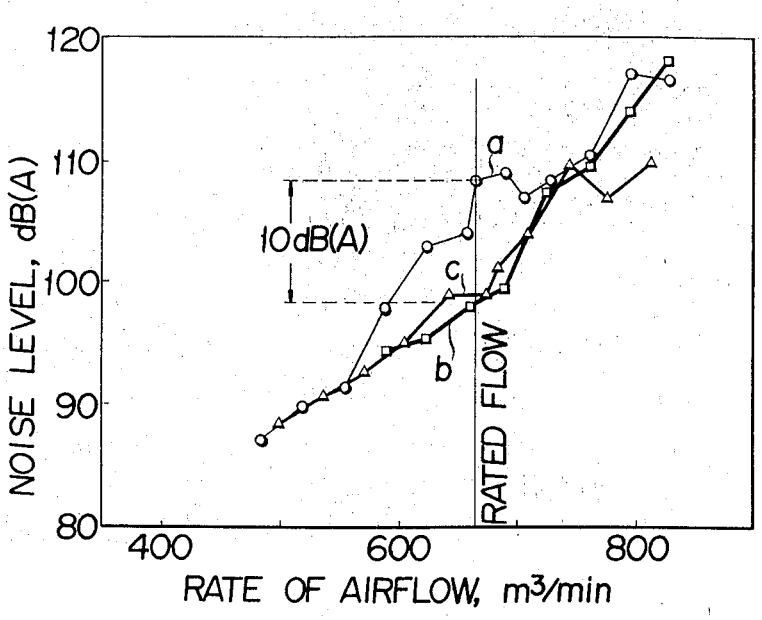
FIG. 5 is a graph plotting the curves of the noise level produced by the experimental radiator of FIG. 4 with and without the baffle plates according to the invention, against the rate of airflow therethrough.

The results are as graphically represented in FIG. 5, in which the curve *a* represents the prior art radiator having no baffle plates, the curve *b* the inventive radiator wherein the distances *x* and *y* are both 170 millimeters (Measure I), and the curve *c* the inventive radiator wherein the distance *x* is 220 millimeters and the distance *y* 310 millimeters (Measure II).

The particular radiator model simulated by the experimental arrangement of FIG. 4 has a rated airflow of 665 cubic meters per minute. At this rated airflow, the noise levels produced by the inventive radiator of Measures I and II above are lower than the noise level produced by the prior art radiator by as much as 10.0 and 9.5 decibels (A), respectively. As will also be noted from the graph of FIG. 5, Measure I is effective at flow rates up to about 720 cubic meters per minute. whereas Measure II is effective at flow rates over 750 cubic meters per minute. It may be added that the provision of the baffle plates 26 in accordance with this invention had no adverse effects on the power consumption by the fan 12.

Figure 6:
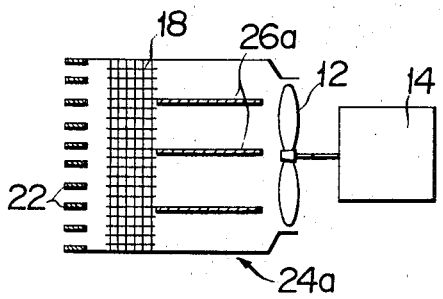
FIG. 6 is a view similar to FIG. 3 but showing another preferred embodiment of the invention.

FIG. 6 illustrates, by way of another preferred embodiment of the invention, a radiator **24*a* wherein a plurality of baffle plates 26*a* are installed on the upstream side of the core 18, in contrast to the embodimment of FIG. 3 wherein the baffle plates are installed on the downstream side of the radiator core. As in the FIG. 3 embodiment the baffle plates 26*a* are arranged in parallel spaced relationship to each other and each extends in the direction of the airflow supplied by the engine-driven fan 12. Other details of construction are substantially as described above in connection with FIGS. 1 and 3** in particular.

As may be apparent, the baffle plates **26*a* should also be effective to distort the aforesaid sound pressure wave which in this second embodiment is assumed to be produced on the upstream side of the radiator core 18 when the airflow is supplied in excess of the critical rate. In order to ascertain the optimum locations of the baffle plates 26*a* in the transverse radiator direction relative to its core 18, experiment was made by use of arrangement similar to that of FIG. 4** except that the baffle plates were installed on the upstream side of the core.

The results of the experiment were substantially identical with those of the FIG. 3 embodiment graphically summarized in FIG. 5. It is evident from these results that the baffle plates according to the invention are equally effective for reduction of the radiator noise if they are installed on the downstream or upstream side of the radiator core, provided that they are so positioned relative to the radiator core as to minimize the resonance of the core as explained above.

Figure 7:
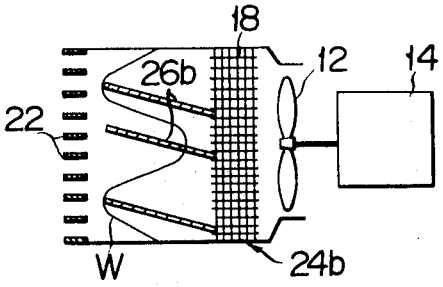
FIG. 7 is also a similar view showing still another preferred embodiment of the invention.

In a radiator **24*b* illustrated in FIG. 7 by way of a further preferred embodiment of the invention, a plurality of baffle plates 26*b* are installed on the downstream side of the core 18 as in the FIG. 3 embodiment and are arranged in parallel spaced relationship to each other as in the two preceding embodiments of FIGS. 3 and 6. In this third embodiment, however, the baffle plates 26*b* are arranged at an angle to the direction in which air would flow through the radiator in the absence of such baffle plates, such airflow being supplied by the engine-driven fan 12. Other details of construction are substantially as set forth above in conjunction with the FIG. 3** embodiment in particular.

For minimizing the radiator noise, the baffle plates **26*b* should also be effective to prevent the resonance of the radiator core 18 when the fan 12 supplies airflow therethrough in excess of the critical rate. The following experiment was conducted with the arrangement shown schematically in FIG. 8 in order to ascertain the optimum locations of the baffle plates 26*b* in the transverse radiator direction relative to the core 18**.

Figure 8:
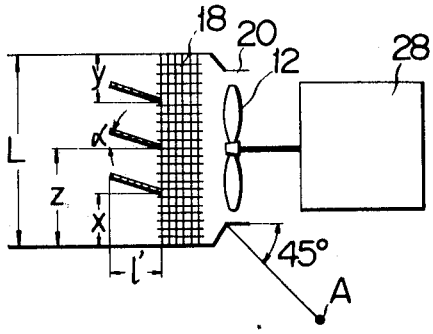
FIG. 8 is also a similar view of experimental equipment employed for finding the optimum locations for baffle plates used in the radiator of FIG. 7.

The experimental arrangement of FIG. 8 is identical with that of FIG. 4 except for the number and disposition of the baffle plates **26*b*. The dimension 1' of each baffle plate 26*b* is 250 millimeters, and the angle $\alpha$ between each baffle plate and the direction of the airflow through the radiator core 18** is 45°. Distances *x*, *y* and *z* were variously changed to observe corresponding changes in noise level at various rates of airflow through the radiator, the airflow being produced by the motor-driven fan 12.

As a result, it has been found that the utmost reduction of the radiator noise is possible when the distances *x* and *y* are both 200 millimeters and the distance Z 590 millimeters. The actual noise levels produced at various rates of airflow when the baffle plates **26*b*** are in such optimum locations were substantially as represented by the curve *c* in the graph of FIG. 5.

While the baffle plates **26*b* are shown angled upwardly in FIGS. 7 and 8, it has been confirmed by experiment that equally favorable results are obtainable if the baffle plates are angled in the opposite direction. Thus, this third embodiment is advantageous in that the airflow supplied by the engine-driven fan 12 can be suitably redirected by the baffle plates so that the heated air streaming out of the core guard 22** may not be applied to workers standing right in front of the radiator.

While the radiator according to this invention has been shown and described hereinbefore in terms of several specific forms it may assume in practice, it is understood that the invention itself is not to be restricted by the exact showing of the accompanying drawings or the description thereof. The invention, therefore, should be construed broadly and in a manner consistent with the fair meaning or proper scope of the following claims.

What is claimed is:

1. In a radiator having a core arranged opposite to an engine-driven fan adapted to supply airflow therethrough, wherein sound pressure waves having crests and roots are formed when the rate of airflow exceeds a critical value, the improvement comprising a means for reducing high intensity sound produced when the rate of airflow exceeds said critical value, said means comprising a plurality of fixedly mounted baffle plates, said baffle plates being positioned downstream in straight-line adjacency parallel with the airflow through said core, said baffle plates being spaced apart from each other in a direction at right angles to the direction of the airflow through said core, the positioning of said plates corresponding to the location of said crests and roots, wherein resonance of said core is minimized when the airflow through said core exceeds said critical value.

* * * * *